US007568415B2

(12) United States Patent
West

(10) Patent No.: US 7,568,415 B2
(45) Date of Patent: Aug. 4, 2009

(54) DEVICE FOR CUTTING MAT AND LINER FOR DOUBLE MATTED FRAMED ARTWORK

(76) Inventor: Allan West, 157 Amberly Ct., Columbia, SC (US) 29212

( * ) Notice: Subject to any disclaimer, the term of this patent is extended or adjusted under 35 U.S.C. 154(b) by 44 days.

(21) Appl. No.: 11/425,509

(22) Filed: Jun. 21, 2006

(65) Prior Publication Data

US 2006/0283293 A1 Dec. 21, 2006

Related U.S. Application Data

(60) Provisional application No. 60/595,285, filed on Jun. 21, 2005.

(51) Int. Cl.
*B26D 5/10* (2006.01)

(52) U.S. Cl. ..... 83/565; 83/745; 33/32.1

(58) Field of Classification Search ..... 83/565, 83/743, 745; 33/562–566, 628, 32.1, 32.3, 33/41.1, 41.4, 41.6, 42; 30/286
See application file for complete search history.

(56) References Cited

U.S. PATENT DOCUMENTS

| | | | | | |
|---|---|---|---|---|---|
| 697,997 | A * | 4/1902 | Drinkaus | 83/523 |
| 1,115,333 | A * | 10/1914 | Please | 33/32.1 |
| 1,909,780 | A * | 5/1933 | McCann | 30/293 |
| 2,334,913 | A * | 11/1943 | Eisenberg | 33/566 |
| 3,155,984 | A * | 11/1964 | Derrick | 2/114 |
| 3,156,984 | A * | 11/1964 | Palmer | 33/613 |
| 3,463,041 | A * | 8/1969 | Perlmutter et al. | 83/564 |
| 3,787,968 | A * | 1/1974 | Littmann | 30/124 |
| 3,961,552 | A * | 6/1976 | Graham | 83/821 |
| 4,022,095 | A * | 5/1977 | Jones | 83/455 |
| 4,038,751 | A * | 8/1977 | Albright | 30/293 |
| 4,096,631 | A * | 6/1978 | Ward | 30/294 |
| 4,158,977 | A * | 6/1979 | Logan | 83/522.16 |
| 4,203,227 | A * | 5/1980 | Giroux | 33/458 |
| 4,382,590 | A * | 5/1983 | Pandya et al. | 269/87.2 |
| 4,440,055 | A * | 4/1984 | Gelfand | 83/529 |
| 4,458,133 | A * | 7/1984 | Macken | 219/121.67 |
| 4,631,997 | A * | 12/1986 | Sobel | 83/29 |
| 4,739,558 | A * | 4/1988 | Black | 33/42 |
| 4,936,020 | A * | 6/1990 | Neblett | 33/566 |
| 5,271,305 | A * | 12/1993 | Peters et al. | 83/455 |
| 5,309,642 | A * | 5/1994 | McGinnis | 33/32.2 |
| 5,511,316 | A * | 4/1996 | Fischer et al. | 33/1 F |
| 5,829,150 | A * | 11/1998 | McEligot | 33/562 |
| 5,865,928 | A * | 2/1999 | Lariviere et al. | 156/256 |
| 6,321,457 | B1 * | 11/2001 | Lariviere et al. | 33/562 |
| 6,986,210 | B1 * | 1/2006 | Conway | 33/562 |
| 2002/0134213 | A1 * | 9/2002 | Causse et al. | 83/565 |
| 2004/0016332 | A1 * | 1/2004 | Price et al. | 83/455 |
| 2004/0143979 | A1 * | 7/2004 | Albright et al. | 33/42 |

* cited by examiner

*Primary Examiner*—Jason Daniel Prone
*Assistant Examiner*—Joseph DeFrank
(74) *Attorney, Agent, or Firm*—Calhoun Thomas, III; Samuel Alexander Long, Jr.

(57) ABSTRACT

The invention is a device and method that allows a user to easily and efficiently hand cut a mat and liner without the need to reposition the mat board. The notched features of the top frame and the different widths of the cutter guides set the parameters for the beginning and of each cut on a mat or a liner for a framed and double matted piece of artwork. Consequently these cuts may be made by a user with limited need for the degree of care which is commonly required in mat cutting using current technology.

1 Claim, 5 Drawing Sheets

Fig. 3
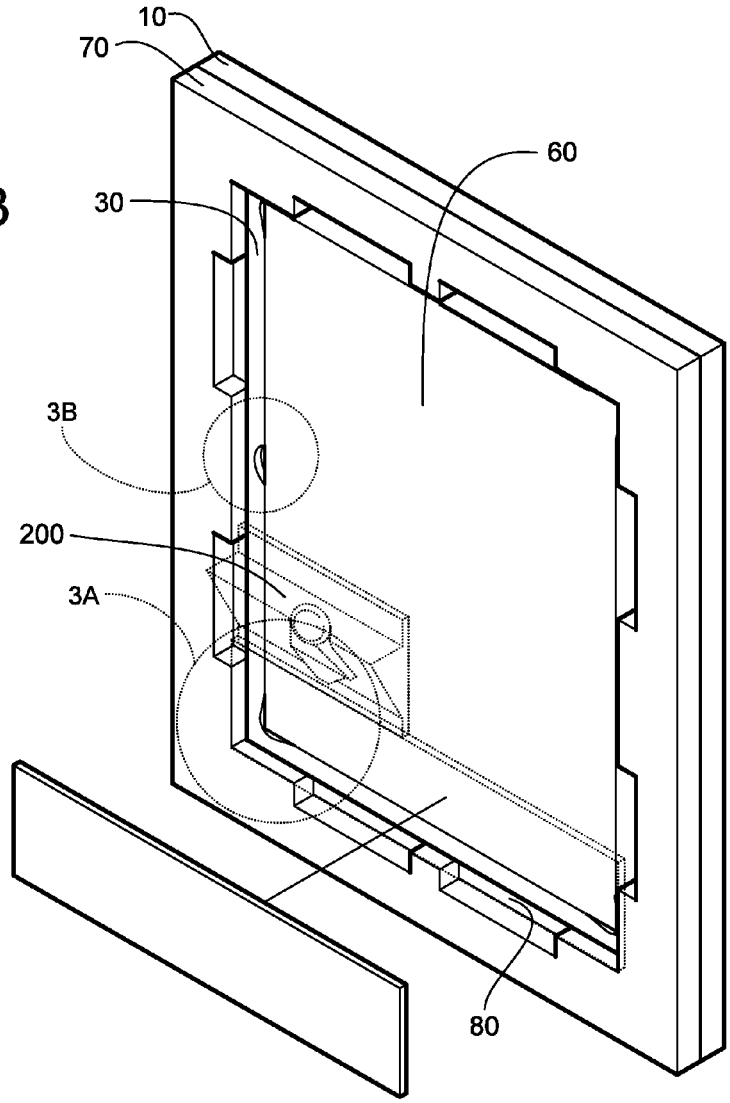
Fig. 3A
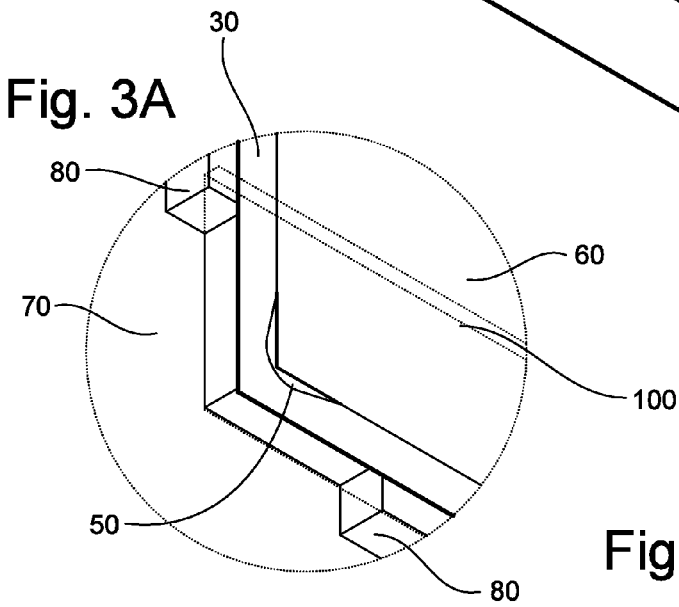
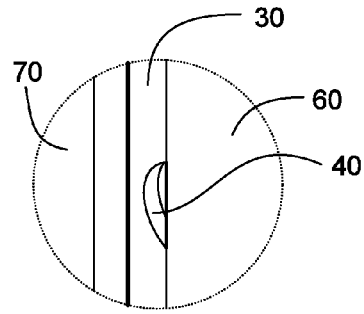
Fig. 3B

DEVICE FOR CUTTING MAT AND LINER FOR DOUBLE MATTED FRAMED ARTWORK

RELATED APPLICATIONS

This application is filed pursuant to a Provisional Patent Application having Application No. 60/595,285 filed on Jun. 21, 2005.

FEDERALLY SPONSORED RESEARCH OR DEVELOPMENT

Not applicable.

REFERENCED OR INCORPORATED MATERIAL

Not applicable.

BACKGROUND OF INVENTION

The present invention relates to a device and a method which allows the user to cut a mat and a liner for specific size picture frames in a manner that is faster and less expensive than present methods such as computerized cutting devices or devices for hand cutting mats. The user of this invention is normally an artist, framer, or dealer who sells prints in an industry standard size in large quantities. The use of this invention can result in significant cost savings and give these users a price advantage.

The use of a hand held cutting device made of a blade holder designed for sliding on flat surfaces and its associated blade (hereinafter the "cutting device") against a typical straight edge apparatus to cut a mat board is old art. One can review a framing and related products catalogue and see numerous examples of such straight edge devices. Examples of such catalogues include: DickBlick, FramCo, Logan Graphic Products, Curry's Artists Materials, and Framing4yourself. The simplest example of these devices may be a straight edge guide similar to a ruler against which a hand-held mat cutter is pressed and slid along to make a straight cut. Other versions may be a straight edge guide with a bar that has a mat cutting device attached in a slidable manner. Other versions involve an "L" shape where the "L" helps to keep the mat at a 90 degree position. Each of these devices requires that the user reposition the mat board after each cut or pair of cuts. This repositioning of the mat board that is being cut provides opportunities for user created error. Typically each straight, beveled side of a mat is cut using a device or devices such as those mentioned above. Also, each of these devices must be set up for each size mat ahead of time before cutting may begin.

Other devices used for cutting mat boards include computer controlled mechanical cutting devices. These devices suffer in comparison to the present invention in that they are substantially more expensive, complex and bulky. Additionally, they cannot typically be used with the same speed and efficiency of the present invention. The inventor believes that the present invention is the only device and method designed for rapidly cutting single or double mats of particular sizes and the only manual version of such device and method where the mat board remains in a fixed position during all four cuts.

SUMMARY OF THE INVENTION

The present invention relates to a device and method that uses inexpensive components to enable a user to easily and efficiently cut a mat and a liner for use in double matting framed artworks. The invention can be used to cut single mats for similar use, but that is not its primary function. The components can be sized and otherwise configured in ways that allow more than one size mat to be cut on the invention frame. The present invention has been made to solve problems associated with the use and positioning of basic straight edges and "L" shaped guides that are common in the industry. For example, it is common to have to make pencil or other similar marks on the blank mat board where an opening is to be cut. Careful measurements and lines must often be made and this can cause the user to have to spend approximately 3 to 5 minutes marking and cutting each mat board. The present invention allows the mat board to be cut without having to make any such measurements and pencil marks. This is achieved by the use of a preconfigured template or frame of a nature designed to appropriately interact with one or more industry-standard handheld cutting devices. Additionally, the configuration of the present invention components facilitates the speed and safety with which a user can make the desired hand-cut mats.

BRIEF DESCRIPTION OF THE SEVERAL VIEWS OF THE DRAWINGS

FIG. 3 is a view of the template portion of the invention holding a blank mat board (60) in place, a wide cutter guide (120) (shown without the flip over extension) inserted into position and an standard handheld mat cutting device (200) positioned against the cutter guide (120) in such a manner that it will not fit into the applicable side notch (80) in the top frame of the template;

FIG. 3A is a view of the corner cut-out (50) in the mat holder (30) with the mat board (60) in place and highlights the cutter guide (100);

FIG. 3B is a view of the thumb notch (40) on the side of the mat holder (30) with the mat board (60) in place;

DETAILED DESCRIPTION

Figure 1:
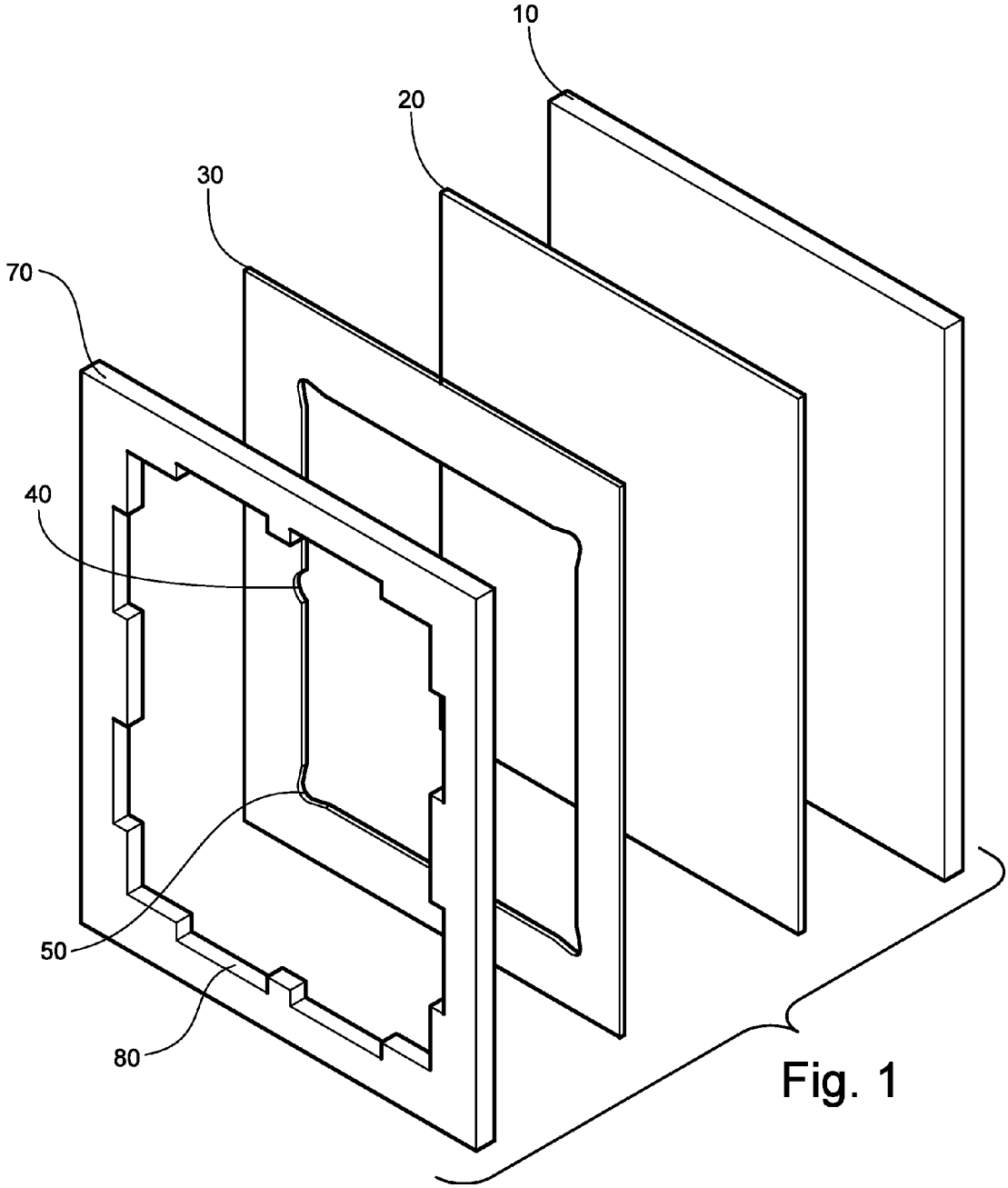
FIG. 1 is an exploded view of the template portion of the invention showing a top frame (70), a mat holder (30), a protective mat board layer (20), and a base (10)
Figure 2:
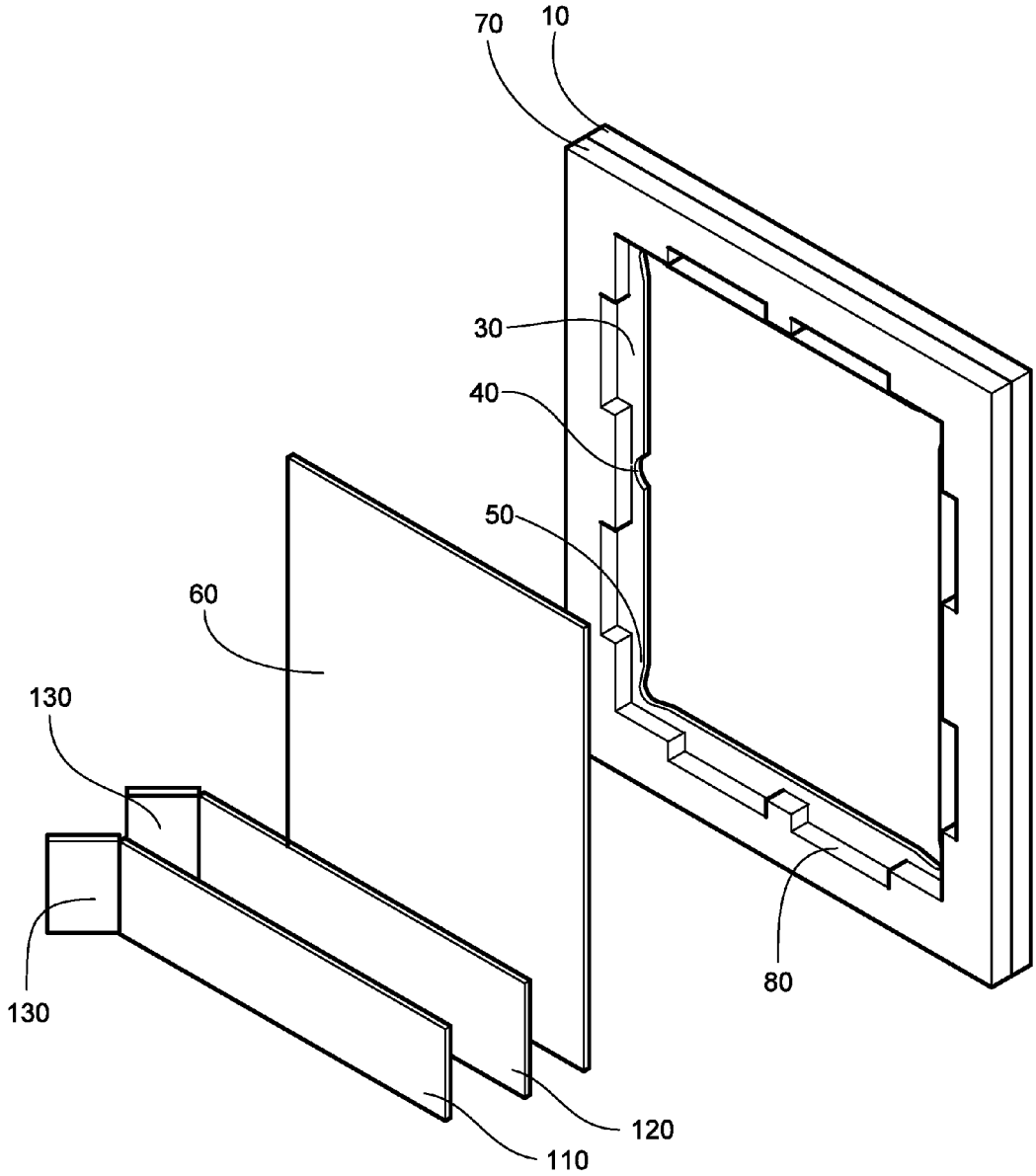
FIG. 2 is a view of two cutter guides showing their differing widths (110 & 120) and their flip over extensions (130), a blank mat board (60) about to be inserted for cutting to be a mat or liner, and an assembled template portion of the invention.
Figure 4A:
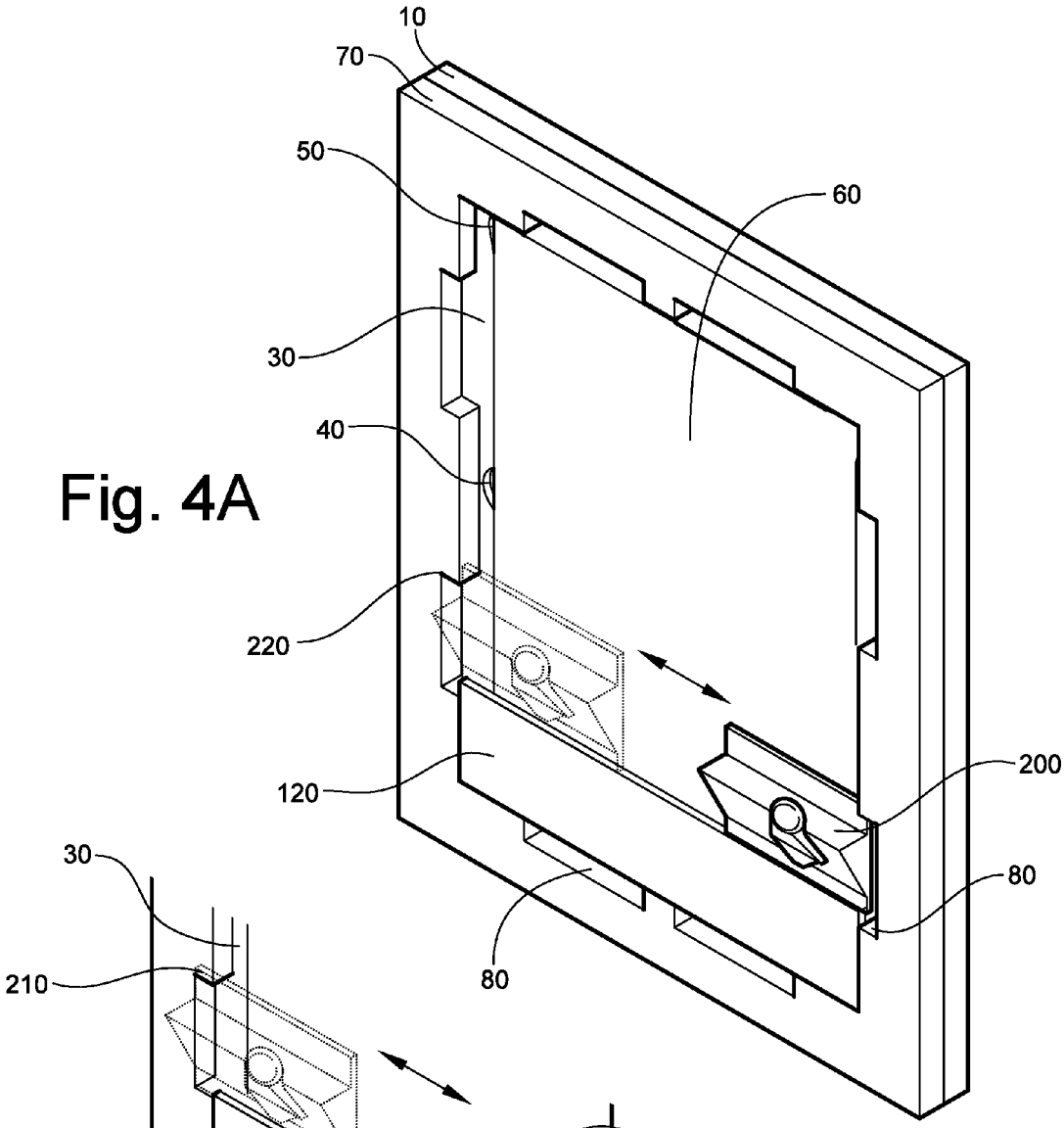
FIG. 4A is a view of a standard handheld mat cutting device (200) being used to make a cut with the wide cutter guide (120) (shown without flip over extension) in such a fashion that the cutting device (200) will not fit in the applicable side notches (80) at either end of the cutter guide (120)
Figure 4B:
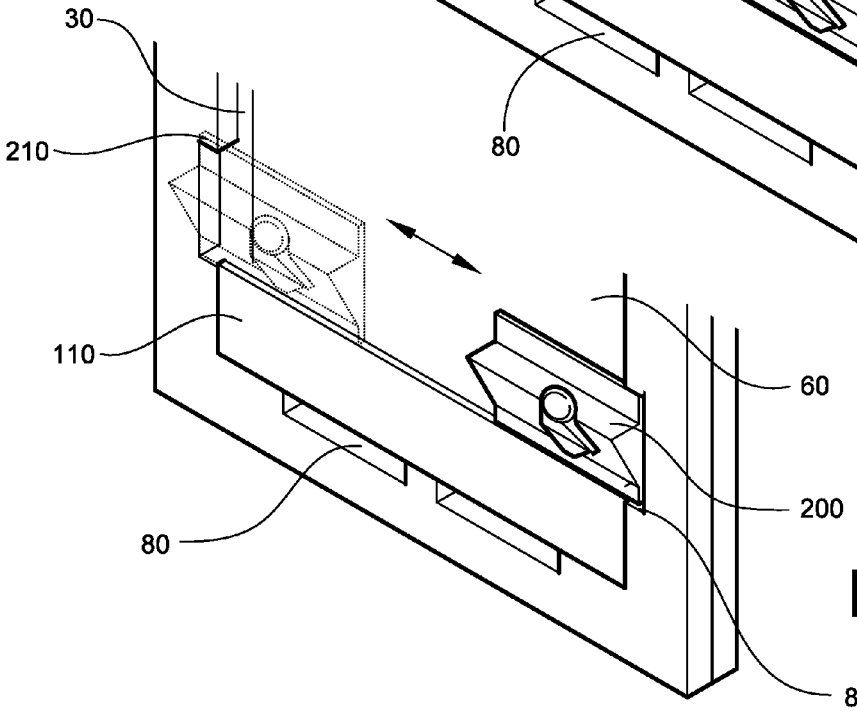
FIG. 4B is a view of a standard handheld mat cutting device (200) being used to make a cut with the narrow cutter guide (110) (shown without flip over extension) in such a fashion that the cutting device (200) will fit in the applicable side notches (80) at either end of the cutter guide (110)
Figure 5:
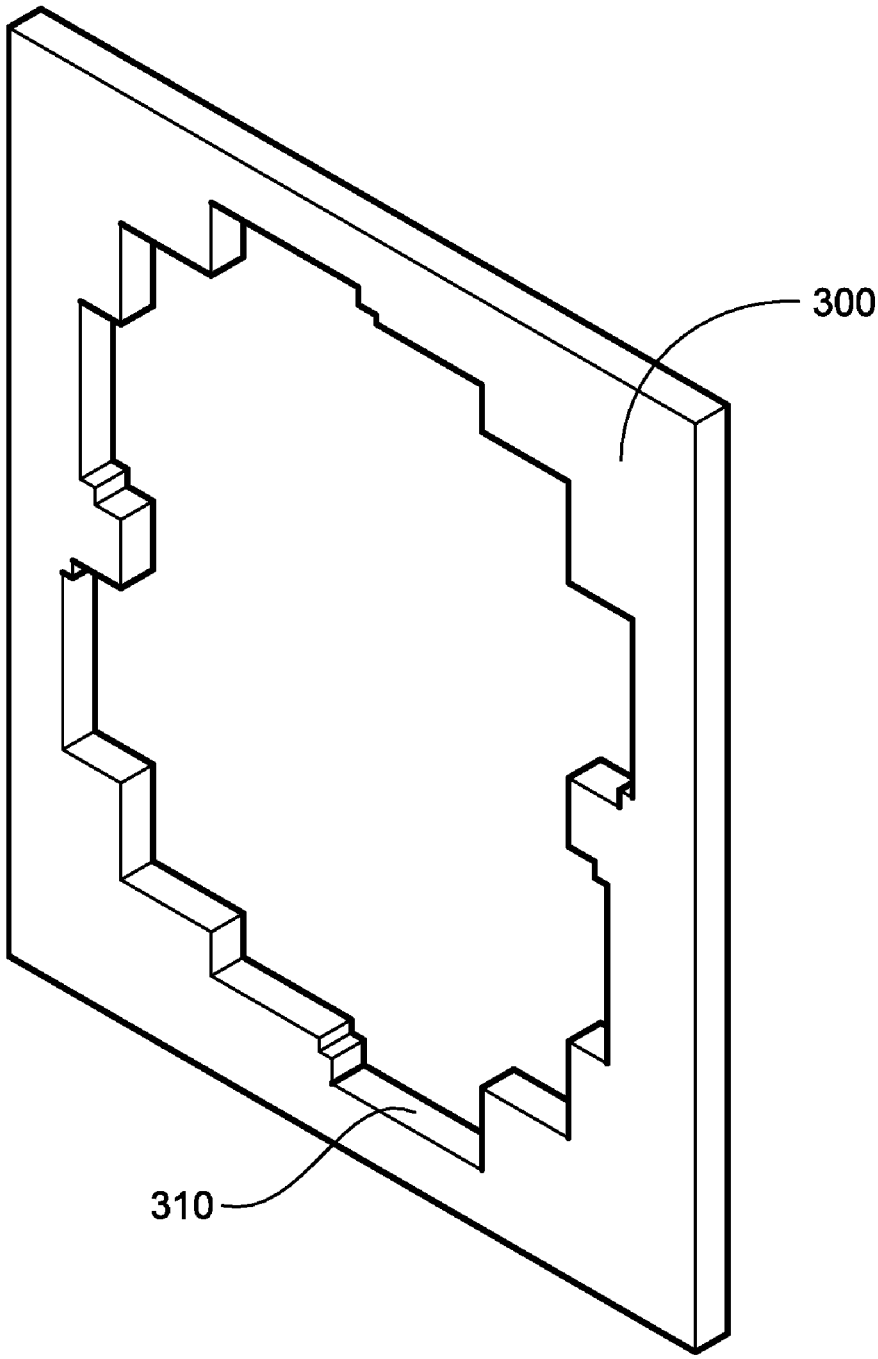
FIG. 5 is a view of an alternative embodiment of the top frame (300) on the template portion of the invention for use with an alternative handheld mat cutting device that is of a different size and orientation thereby requiring different notching (310).

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The preferred embodiment of the present invention contemplates the use of a hand-held cutting device (200). As noted above, these hand-held cutting devices are well known in the industry, however, as used with the present invention the handheld cutting device (200) selected by the user must be within a particular size range to work with the mat cutting template of the present invention. In this embodiment, the template is generally a rectangular base (10) with a top frame (70) containing notches (80) attached. In between the top frame (70) and the base (10) are sandwiched a mat holder (30) and a protective mat board (20). The protective mat board (20) is disposable as its purpose is to keep the tip of the cutting blade of cutting device (200) from coming into contact with the harder surface of the base (10), however, an alternative embodiment of the invention could dispense with this protective mat board (20) and use a base (10) made of material that will withstand occasional contact with the cutting blade of the cutting device (200). The center of the template is flat within the center of the mat holder (30) and this is where a blank mat board (60) is placed to be cut. The mat holder (30) and the blank mat board (60) are of approximately the same thickness. The thumb or finger notches (40) at the sides and the corner notches (50) at the corners of the mat holder make it easier for the user to remove the mat or liner from the mat holder (30). The template can be created to fit industry-standard mat sizes, particularly those for 8"×10" artworks. In another alternative embodiment for larger sized artworks, the mat holder becomes unnecessary as the frame itself can serve the function of holding the blank mat board (60) in place while being cut. Accordingly, the templates that are used in the mat cutting system of the present invention are sized to fit and securely hold in place blank pieces of mat board of standard sizes, however, they can be sized and configured to be used with other less standard size mat blanks. Moreover, an alternate top frame (300) of the template can be designed to work with cutting devices of varying sizes by adjusting the notch (310) placement, sizing, and orientation.

Each template comes with two cutter guides (110 & 120) that are sized to be used with their particular template. The cutter guides (110 & 120) are the same length, however they are different widths. The difference in their widths is the difference in the opening sizes that are cut into a blank mat board (60) to create a mat and its liner. Thus, according to the different widths, the cutting guides can be classified into narrow cutting guides (110) (for longer cuts for the mat with the larger opening) and wide cutting guides (120) (for shorter cuts for the liner with the smaller opening). Using these two cutter guides and the top frame (70) with notches (80) of the template, the user can efficiently cut two different inside openings in two blank mat boards (60). This gives the user the opportunity to quickly and easily cut both a mat and a liner. The speed with which a mat or its associated liner, if applicable, can be cut can be accelerated from approximately 3 to 5 minutes using current methods common in the industry to approximately 10 seconds using the present invention.

The top frame (70) is notched (80) at the points where the user will want the handheld mat cutting device (200) to cut the largest opening for the mat. The cutter fits (210) into these notches (80) at the beginning and end of a cut along one side of the frame because the narrower cutter guide (110) is used. When the wider cutter guide (120) is used in creating the liner, the cutter is restricted from entering (220) the notched area (80) and consequently the cut opening is slightly smaller. The difference between the widths of the wider cutter guide (120) and narrower cutter guide (110) defines how much of the liner will be visible under the mat in a double matted piece of framed artwork.

Naturally several different materials such as wood, plastic, or metal may be used in the construction of the present invention and these and other modifications and variations may be practiced by one of ordinary skill in the art, without departing from the spirit and scope of the present invention. In addition, it should be understood that aspects of the various embodiments may be interchanged both in whole and in part. Furthermore, those of ordinary skill in the art will appreciate that the foregoing description is by way of example only, and is not intended to limit the invention to be further described in the claims.

What is claimed is:

1. A mat cutting apparatus comprising:

a cutting device having a rectangular blade holder for sliding on flat surfaces with a blade parallel to a length of said rectangular blade holder and perpendicular to a width of said rectangular blade holder;

a top frame, said top frame comprising a plurality of notches cut into an inner perimeter of said top frame, said notches having a width and a depth, said width being sized slightly larger than the width of said rectangular blade holder of said cutting device such that the cutting device is able to enter said notches in order to make a long cut that is longer than if the cutting device had not entered said notches and, instead, had stopped at the inner perimeter thereby making a short cut;

a mat holder comprising a peripheral border having a plurality of finger notches and corner cut-out notches;

a protective mat board;

a base;

a plurality of narrow cutter guides machined to a length that is slightly less than the distance between two parallel edges of said inner perimeter of said top frame, and machined to a width that is equal to a distance between a corner of said inner perimeter of said top frame and a nearest edge of said notches thereby permitting the length of said rectangular blade holder of said cutting device to slide along the length of said narrow cutter guide and the width of said rectangular blade holder of said cutting device to slide into said notches of said top frame thereby making the long cut; and a plurality of wide cutter guides machined to a length that is slightly less than the distance between two parallel edges of said inner perimeter of said top frame, and machined to a width that is larger than the distance between the corner of said inner perimeter of said top frame and the nearest edge of said notches thereby permitting the length of said rectangular blade holder of said cutting device to slide along the length of said wide cutter guide but restricting the width of said rectangular blade holder of said cutting device from entering into said notches of said top frame thereby making the short cut.

* * * * *